US010850468B2

(12) United States Patent
Zhang et al.

(10) Patent No.: US 10,850,468 B2
(45) Date of Patent: Dec. 1, 2020

(54) HIGH-SPEED HYDRAULIC FORGING PRESS

(71) Applicant: Zhongjuxin Ocean Engineering Equipment Co., Ltd, Jiangsu (CN)

(72) Inventors: Lianhua Zhang, Yancheng (CN); Hui Zhang, Yancheng (CN); Haijun Ma, Yancheng (CN)

(73) Assignee: ZHONGJUXIN OCEAN ENGINEERING EQUIPMENT CO., LTD, Jiangsu (CN)

( * ) Notice: Subject to any disclaimer, the term of this patent is extended or adjusted under 35 U.S.C. 154(b) by 212 days.

(21) Appl. No.: 15/765,265

(22) PCT Filed: Jan. 12, 2017

(86) PCT No.: PCT/CN2017/070940
§ 371 (c)(1),
(2) Date: Apr. 1, 2018

(87) PCT Pub. No.: WO2018/014522
PCT Pub. Date: Jan. 25, 2018

(65) Prior Publication Data

US 2018/0281332 A1 Oct. 4, 2018

(30) Foreign Application Priority Data

Jul. 22, 2016 (CN) ..... 2016 1 0582538

(51) Int. Cl.
*B30B 15/16* (2006.01)
*B30B 15/22* (2006.01)

(52) U.S. Cl.
CPC ..... *B30B 15/161* (2013.01); *B30B 15/163* (2013.01); *B30B 15/22* (2013.01)

(58) Field of Classification Search
CPC ..... B30B 15/16; B30B 15/161; B30B 15/163; B30B 15/18; B30B 15/20; B30B 15/22;
(Continued)

(56) References Cited

U.S. PATENT DOCUMENTS 2,380,153 A * 7/1945 Davis ..... B21D 24/14 72/20.4
2,594,204 A * 4/1952 Nowak ..... B21D 5/015 72/441

(Continued)

FOREIGN PATENT DOCUMENTS

CN 202291180 * 7/2012 ..... B21J 13/00

OTHER PUBLICATIONS

Shanwu, Translation of CN-202291180 (Year: 2012).*

*Primary Examiner* — Adam J Eiseman
*Assistant Examiner* — Bobby Yeonjin Kim
(74) *Attorney, Agent, or Firm* — Han IP PLLC; Andy M. Han

(57) ABSTRACT

A high-speed hydraulic forging press is disclosed. The high-speed hydraulic forging press includes a forging hammer, a movable beam, a main hydraulic cylinder, a single-rod elevation hydraulic cylinder, a plurality of main hydraulic pumps, a high-pressure energy accumulator, an intermediate-pressure energy accumulator, an oil tank, a programmable logic controller and a valve-regulation system. During a rolling process, when a rolling resistance applied to the forging hammer increases to cause pressure in the main hydraulic cylinder to reach a predetermined value, the programmable logic controller controls the valve-regulation system so that the high-pressure energy accumulator stops supplying the hydraulic oil to the main hydraulic cylinder, and that the hydraulic oil in the main hydraulic cylinder is supplied by at least one of the plurality of main hydraulic pumps. The high-speed hydraulic forging press exhibits remarkable advantages including a reasonable resource allocation, a simple structure, low equipment investment, and high energy utilization.

9 Claims, 1 Drawing Sheet

(58) Field of Classification Search
CPC ..... B30B 15/26; B21J 7/28; B21J 7/40; B21J 9/12; B21J 7/46; B21J 9/20
USPC .... 72/453.02, 453.06, 453.08, 453.12, 453.1
See application file for complete search history.

(56) References Cited

U.S. PATENT DOCUMENTS

| | | | | | |
|---|---|---|---|---|---|
| 3,158,046 | A * | 11/1964 | Steinfort | B21J 9/12 | 72/453.09 |
| 4,125,010 | A * | 11/1978 | Adam | B30B 15/16 | 72/453.06 |
| 4,235,088 | A * | 11/1980 | Kreiskorte | B21J 9/12 | 100/269.05 |
| 4,291,571 | A * | 9/1981 | Claussen | B21J 9/12 | 100/214 |
| 4,890,475 | A * | 1/1990 | Baltschun | B21D 28/20 | 100/214 |
| 5,852,933 | A * | 12/1998 | Schmidt | F15B 3/00 | 60/413 |
| 6,634,205 | B2 * | 10/2003 | Yashima | B21J 9/12 | 100/269.06 |
| 2016/0084280 | A1 * | 3/2016 | Maier | F15B 11/022 | |
| 2018/0214932 | A1 * | 8/2018 | Kohno | B30B 15/163 | |

* cited by examiner

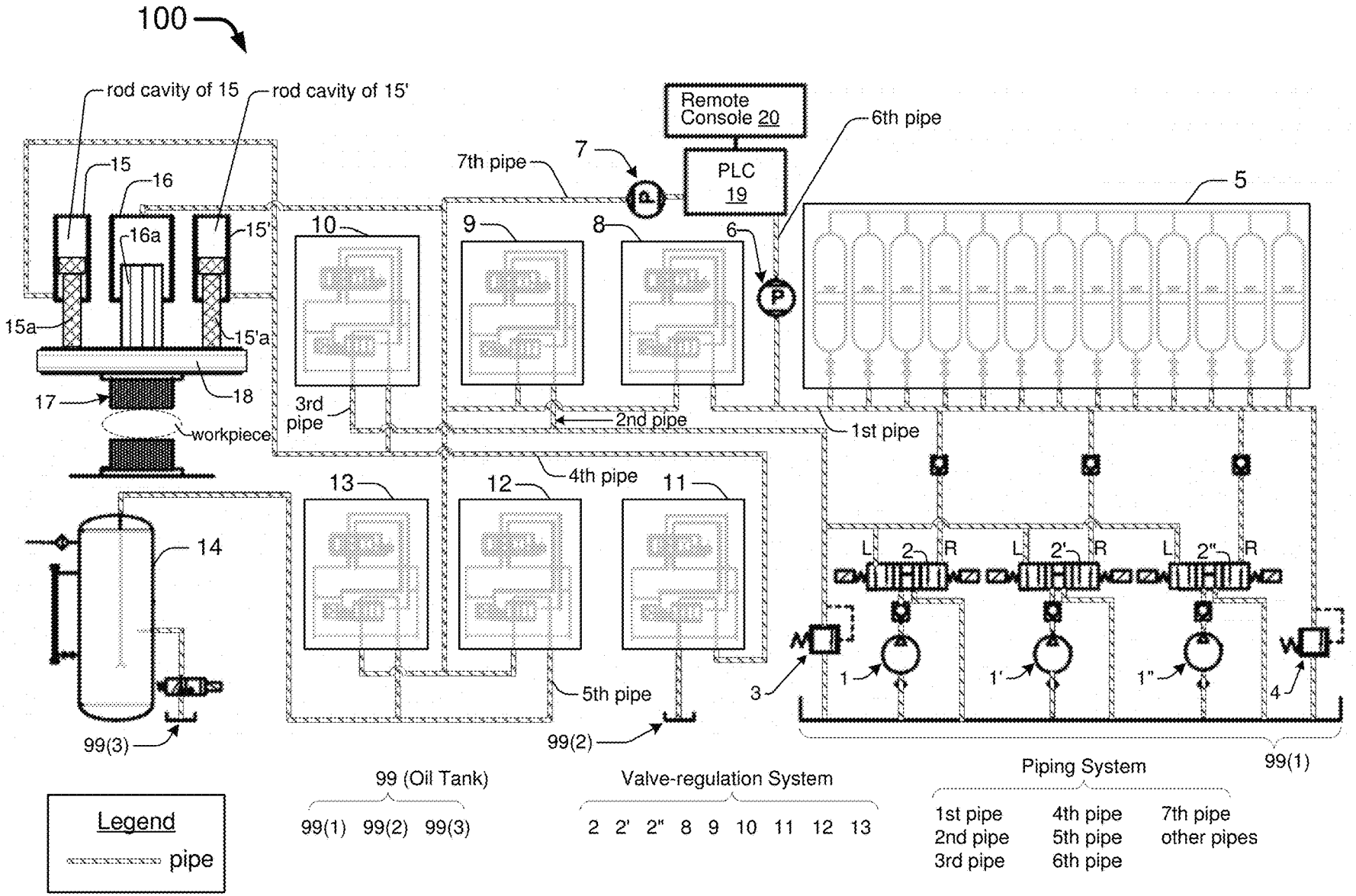
100
Remote Console 20
PLC 19
6th pipe
1st pipe
2nd pipe
3rd pipe
4th pipe
5th pipe
7th pipe
rod cavity of 15
rod cavity of 15'
workpiece
Piping System
1st pipe
2nd pipe
3rd pipe
4th pipe
5th pipe
6th pipe
7th pipe
other pipes
Valve-regulation System
2 2' 2" 8 9 10 11 12 13
99 (Oil Tank)
99(1) 99(2) 99(3)
Legend
pipe

HIGH-SPEED HYDRAULIC FORGING PRESS

CROSS-REFERENCE TO RELATED APPLICATION

This application is the U.S. national stage application of International Application No. PCT/CN2017/070940, filed on Jan. 12, 2017, which claims the priority benefit of China Patent Application No. 2016105825387, filed on Jul. 22, 2016. The above-identified patent applications are hereby incorporated by reference in their entirety.

TECHNICAL FIELD

The present disclosure generally relates to techniques of hydraulic transmission control and, more particularly, to a high-speed hydraulic forging press.

BACKGROUND

High-speed hydraulic forging presses are novel forging apparatuses preferably used in high-end forging industries, both local and abroad. High-speed hydraulic forging presses typically exhibit advantages such as a higher degree of automation, high-precision control, and economical consumption of raw materials. Therefore, high-speed hydraulic forging presses are widely employed in machinery manufacturing and forging of high quality/high performance material. Currently, better high-speed forging presses made in China use components that are designed and manufactured according to advanced international standards. Some key components of the better high-speed forging presses are even imported from name-brand companies overseas. The use of these high-quality and/or imported components has contributed to a rather high manufacturing cost of the better speed forging presses. Due to relatively high energy consumption of the forging presses, excessive electric power in particular, a larger scale of investment is normally required for an enterprise employing the forging presses. Therefore, economic benefits of production and operation of the enterprise may be largely affected by the forging presses.

An operation process of a conventional hydraulic forging press may be illustrated by the following example steps or phases of a 16 MN high-speed forging press, as follows:

1. Start: Six main hydraulic pumps may start without loads, with each of the main hydraulic pumps having a rated power of 250 kilowatts (kW).

2. Backhaul: Three of the main hydraulic pumps may supply oil to single-rod elevation hydraulic cylinders on two sides, causing a hammer to rise. Oil in a main hydraulic cylinder may be discharged into a low-pressure energy accumulator. The remaining three main hydraulic pumps may run without loads.

3. Fast drop in an idle stroke: The six main hydraulic pumps and the low-pressure energy accumulator may supply oil to the main hydraulic cylinder at the same time. The hammer may rapidly drop until the hammer touches a workpiece. Oil in the single-rod elevation hydraulic cylinders on the two sides may be discharged into an oil tank.

4. Rolling: The low-pressure energy accumulator may be closed, and the six main hydraulic pumps may continue supplying oil to the main hydraulic cylinder. As resistance from the workpiece increases continuously, pressure of the six main hydraulic pumps may increase accordingly. When the pressure of the main hydraulic pumps reaches a specified or predetermined value, five of the six main hydraulic pumps may switch to running without loads, and only the remaining one main hydraulic pump may continue working (i.e., running with a load). At this moment, a rolling velocity may quickly decrease. When a size of the workpiece meets a predetermined requirement, or when the workpiece cannot be rolled any further, the rolling may end.

Based on the operation of the 16 MN high-speed hydraulic forging press described above, a conventional forging press may have the following operation states: (a) When the hammer of the hydraulic forging press is rising (i.e., during the backhaul), three main hydraulic pumps may run without loads, which means a no-load operation power (i.e., an operation power without load) of the main hydraulic pumps may collectively reaches 100 kW×3=300 kW or so. (b) During rolling, when the pressure of the main hydraulic pumps reaches the predetermined value, five of the six main hydraulic pumps may run without loads, and only one main hydraulic pump may continue working, which means a no-load operation power of the five main hydraulic pumps may reach 100 kW×5=500 kW or so. Obviously, resource allocation of a plurality of main hydraulic pumps of a conventional high-speed hydraulic forging press is inappropriate; in particular, no-load operation power of the main hydraulic pumps is too high. Because a relatively large quantity of pumps is employed by the conventional high-speed hydraulic forging press, equipment investment cost is increased, and a power capacity expansion need is also increased. Moreover, a basic electricity charge (e.g., 30 RMB dollars per kW per month) may increase due to the large power capacity expansion, and investment in power supply facilities may further increase, causing wasted resources.

SUMMARY

This section is for the purpose of summarizing some aspects of the present disclosure and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present disclosure.

In order to address the various technical disadvantages of a conventional high-speed hydraulic forging press as described above, including at least an increase in equipment investment, an increase in power capacity expansion, and a relatively high no-load energy consumption resulted from an inappropriate quantity and resource allocation of the hydraulic pumps therein, the present disclosure hereby provides an improved high-speed hydraulic forging press.

To resolve the aforementioned problem, the present disclosure provides a high-speed hydraulic forging press that may include a forging hammer, a movable beam, a main hydraulic cylinder, a single-rod elevation hydraulic cylinder, a plurality of main hydraulic pumps, a high-pressure energy accumulator, an intermediate-pressure energy accumulator, an oil tank, and a programmable logic controller. The high-speed hydraulic forging press may also include a piping system that is used to transmit hydraulic oil between, and is connected with, the main hydraulic cylinder, the single-rod elevation hydraulic cylinder, the plurality of main hydraulic pumps, the high-pressure energy accumulator, the intermediate-pressure energy accumulator and the oil tank. The high-speed hydraulic forging press may further include a valve-regulation system disposed on the piping system. The main hydraulic cylinder may be a plunger-type hydraulic cylinder. One end of a single rod of the single-rod elevation hydraulic cylinder, one end of a plunger of the main hydraulic cylinder and the forging hammer may be fixedly connected to the movable beam. When the forging hammer rises during a backhaul, the programmable logic controller may control the valve-regulation system so that hydraulic oil in a rod cavity of the single-rod elevation hydraulic cylinder may be supplied by the plurality of main hydraulic pumps, and that hydraulic oil in the main hydraulic cylinder may be discharged into the intermediate-pressure energy accumulator. When the forging hammer drops fast in an idle stroke, the programmable logic controller may control the valve-regulation system so that hydraulic oil in the main hydraulic cylinder may be solely supplied by the intermediate-pressure energy accumulator, that the hydraulic oil in the rod cavity of the single-rod elevation hydraulic cylinder may be discharged into the oil tank, and that the main hydraulic cylinder may meanwhile supply hydraulic oil to the high-pressure energy accumulator to accumulate energy therein. When the forging hammer rolls the workpiece, the programmable logic controller may control the valve-regulation system so that the hydraulic oil in the main hydraulic cylinder may be supplied by the main hydraulic pumps as well as the high-pressure energy accumulator at the same time. When a rolling resistance applied to the forging hammer by the workpiece increases to cause pressure in the main hydraulic cylinder to reach a first predetermined value, the programmable logic controller may control the valve-regulation system so that the high-pressure energy accumulator may stop supplying hydraulic oil to the main hydraulic cylinder, and that the hydraulic oil in the main hydraulic cylinder may be supplied by at least one of the plurality of main hydraulic pumps.

In some embodiments, when the rolling resistance increases to cause the pressure in the main hydraulic cylinder to reach the first predetermined value but not a second predetermined value greater than the first predetermined value, the programmable logic controller may control the valve-regulation system so that the high-pressure energy accumulator may stop supplying hydraulic oil to the main hydraulic cylinder, and that the hydraulic oil in the main hydraulic cylinder may be supplied by each of the plurality of main hydraulic pumps. When the rolling resistance applied to the forging hammer increases to cause the pressure in the main hydraulic cylinder to further reaches the second predetermined value, the programmable logic controller may control the valve-regulation system so that one or more of the plurality of main hydraulic pumps may be switched to supplying hydraulic oil to the high-pressure energy accumulator to accumulate energy therein, and that the hydraulic oil in the main hydraulic cylinder may be supplied by remaining of the plurality main hydraulic pumps that are not switched.

In some embodiments, when the rolling resistance increases to cause the pressure in the main hydraulic cylinder to further reach a third predetermined value greater than the second predetermined value, the programmable logic controller controls the valve-regulation system so that all of the plurality of main hydraulic pumps may be switched to supplying hydraulic oil to the high-pressure energy accumulator to accumulate energy therein.

In some embodiments, the valve-regulation system may include one or more electromagnetic reversing valves respectively disposed on one or more of the pipes of the piping system. Via the one or more of the pipes, the main hydraulic pumps may output hydraulic oil. The one or more electromagnetic reversing valves may be controlled by the programmable logic controller such that each of the plurality of main hydraulic pumps may supply hydraulic oil to the main hydraulic cylinder, the single-rod elevation hydraulic cylinder or the high-pressure energy accumulator. In some embodiments, the valve-regulation system may also include a first electro-hydraulic proportional valve. The first electro-hydraulic proportional valve may be disposed on a first pipe of the piping system. Via the first pipe, the high-pressure energy accumulator may supply hydraulic oil to the main hydraulic cylinder. The first electro-hydraulic proportional valve controlled by the programmable logic controller to establish or disable a hydraulic connection of the first pipe. In some embodiments, the valve-regulation system may also include a second electro-hydraulic proportional valve. The second electro-hydraulic proportional valve may be disposed on a second pipe of the piping system. Via the second pipe, the plurality of main hydraulic pumps may supply hydraulic oil to the main hydraulic cylinder. The second electro-hydraulic proportional valve may be controlled by the programmable logic controller to establish or disable a hydraulic connection of the second pipe. In some embodiments, the valve-regulation system may also include a third electro-hydraulic proportional valve. The third electro-hydraulic proportional valve may be disposed on a third pipe of the piping system. Via the third pipe, the plurality of main hydraulic pumps may supply hydraulic oil to the rod cavity of the single-rod elevation hydraulic cylinder. The third electro-hydraulic proportional valve may be controlled by the programmable logic controller to establish or disable a hydraulic connection of the third pipe. In some embodiments, the valve-regulation system may also include a fourth electro-hydraulic proportional valve. The fourth electro-hydraulic proportional valve may be disposed on a fourth pipe of the piping system. The fourth pipe may be disposed between the oil tank and the rod cavity of the single-rod hydraulic cylinder. The fourth electro-hydraulic proportional valve may be controlled by the programmable logic controller to establish or disable a hydraulic connection of the fourth pipe. In some embodiments, the valve-regulation system may also include a fifth electro-hydraulic proportional valve. The fifth electro-hydraulic proportional valve may be disposed on a fifth pipe of the piping system. The fifth pipe may connect the intermediate-pressure energy accumulator and the main hydraulic cylinder. The fifth electro-hydraulic proportional valve may be controlled by the programmable logic controller to establish or disable a hydraulic connection of the fifth pipe. In some embodiments, the high-speed hydraulic forging press may also include a first sensor and a second sensor. The first sensor may be disposed on a sixth pipe of the piping system. Via the sixth pipe, the high-pressure energy accumulator may output hydraulic oil. The second sensor may be disposed on a seventh pipe of the piping system. The seventh pipe may be hydraulically connected to the main hydraulic cylinder.

In some embodiments, the high-speed hydraulic forging press may further include a remote console. The programmable logic controller may control the one or more electromagnetic reversing valves and the first, second, third, fourth and fifth electro-hydraulic proportional valves based on sensing signals generated by the first and second sensors and an input signal received via the remote console.

During a start operation phase of the high-speed hydraulic forging press, the programmable logic controller may send a first command to control each of the plurality of the main hydraulic pumps to start without loads.

During a backhaul operation phase of the high-speed hydraulic forging press, the programmable logic controller may send a second command to control the third electro-hydraulic proportional valve and the fifth electro-hydraulic proportional valve to open, to control a left channel of each of the one or more electromagnetic reversing valves to open, and to control the first electro-hydraulic proportional valve, the second electro-hydraulic proportional valve and the fourth electro-hydraulic proportional valve to close. As a result, each of the plurality of main hydraulic pumps may supply hydraulic oil to the rod cavity of the single-rod elevation hydraulic cylinder via the left channel of each of the one or more electromagnetic reversing valves and the third electro-hydraulic proportional valve. The forging hammer may thus rise, and hydraulic oil in the main hydraulic cylinder may be discharged into the intermediate-pressure energy accumulator via the fifth electro-hydraulic proportional valve.

During a fast drop operation phase of the high-speed hydraulic forging press, the programmable logic controller may send a third command to control the fourth electro-hydraulic proportional valve and the fifth electro-hydraulic proportional valve to open, to control a right channel of each of the one or more electromagnetic reversing valves to open, and to control the first electro-hydraulic proportional valve, the second electro-hydraulic proportional valve and the third electro-hydraulic proportional valve to close. As a result, the intermediate-pressure energy accumulator may supply hydraulic oil to the main hydraulic cylinder via the fifth electro-hydraulic proportional valve, and the forging hammer may drop fast in an idle stroke and touch a workpiece quickly. In addition, hydraulic oil in the rod cavity of the single-rod elevation hydraulic cylinder may be discharged into the oil tank via the fourth electro-hydraulic proportional valve, and each of the plurality of main hydraulic pumps may supply, via the right channel of each of the one or more electromagnetic reversing valves, the hydraulic oil to the high-pressure energy accumulator to accumulate energy therein. When the first sensor detects that the pressure in the high-pressure energy accumulator has reached a fourth predetermined value, the programmable logic controller may send a fourth command to control the right channel of each of the one or more electromagnetic reversing valves to close. Each of the plurality of main hydraulic pumps may thus run without loads.

During a rolling operation phase of the high-speed hydraulic forging press, the programmable logic controller may send a fifth command to control the third electro-hydraulic proportional valve and the fifth electro-hydraulic proportional valve to close, to control the first electro-hydraulic proportional valve and the second electro-hydraulic proportional valve to open, and to control the left channel of each of the one or more electromagnetic reversing valves to open. As a result, each of the plurality of main hydraulic pumps may supply hydraulic oil to the main hydraulic cylinder via the second electro-hydraulic proportional valve, and the high-pressure energy accumulator may supply hydraulic oil to the main hydraulic cylinder via the first electro-hydraulic proportional valve at the same time. When the second sensor detects that the pressure in the main hydraulic cylinder has reached the first predetermined value, the programmable logic controller may send a sixth command to control the first electro-hydraulic proportional valve to close, and to keep the left channel of each of the one or more electromagnetic reversing valves to remain open so that the high-pressure energy accumulator may stop supplying hydraulic oil to the main hydraulic cylinder and that the hydraulic oil in the main hydraulic cylinder may be supplied by each of the plurality of main hydraulic pumps. When the second sensor detects that the pressure in the main hydraulic cylinder has reached the second predetermined value, the programmable logic controller may send a seventh command to control the right channel of at least one of the one or more electromagnetic reversing valves to open so that at least one of the plurality of main hydraulic pumps may be switched to supplying hydraulic oil to the high-pressure energy accumulator to accumulate energy therein.

In some embodiments, when the second sensor detects that the pressure in the main hydraulic cylinder has reached a third predetermined value, the programmable logic controller may send an eighth command to control the right channel of each of the one or more electromagnetic reversing valves to open so that each of the plurality of main hydraulic cylinders may be switched to supplying the hydraulic oil to the high-pressure energy accumulator to accumulate energy therein.

In some embodiments, the intermediate-pressure energy accumulator has an energy accumulation pressure rating of 0.3 megapascal (Mpa) to 3 Mpa. In some embodiments, the high-pressure energy accumulator has an energy accumulation pressure rating of 3 Mpa to 35 Mpa.

The following technical solutions are employed in the present disclosure:

According to the present disclosure, due to using a high-pressure energy accumulator, the quantity of main hydraulic pumps is reduced as compared to that of a conventional high-speed hydraulic forging press. In addition, the energy accumulation pressure rating of a low-pressure energy accumulator is also increased as compared to that of a conventional high-speed hydraulic forging press, resulting in at least the following benefits:

1. Since the main hydraulic pumps work with nearly a full load, power utilization of hydraulic pumps is properly allocated. That is, hydraulic oil is supplied to a high-pressure energy accumulator by the main hydraulic pumps running under a no-load condition. When a maximum quantity of hydraulic oil is needed, the main hydraulic pumps and the high-pressure energy accumulator may supply the hydraulic oil concurrently, so as to achieve an effect of concurrent pressure supply provided by a plurality of main hydraulic pumps that resembles a conventional high-speed hydraulic forging press. Therefore, a resource configuration is optimized, equipment investment is reduced, and energy consumption due to no-load running of the hydraulic pump is reduced.

2. Different from a conventional high-speed hydraulic forging press wherein The forging hammer drops fast in an idle stroke to approach a workpiece with a plurality of main hydraulic pumps and a low-pressure energy accumulator concurrently supplying hydraulic oil to a main hydraulic cylinder, This is changed according to the present disclosure. Specifically, according to the present disclosure, when a forging hammer drops fast in an idle stroke to approach a workpiece, an intermediate-pressure energy accumulator solely supplies hydraulic oil to a main hydraulic cylinder, thereby avoiding the phenomenon of energy waste, namely, wasting much power on small equipment.

A high-speed hydraulic forging press according to the present disclosure has remarkable advantages including a reasonable resource allocation, a simple structure, low equipment investment, and high energy utilization.

BRIEF DESCRIPTION OF THE DRAWINGS

These and other features, aspects, and advantages of the present disclosure will become better understood with regard to the following description, appended claims, and accompanying drawings where:

FIG. 1 is a schematic diagram illustrating a hydraulic control principle of a high-speed hydraulic forging press according to an embodiment of the present disclosure, wherein:

1, 1' and 1" are main hydraulic pumps; 2, 2' and 2" are electromagnetic reversing valves; 3 and 4 are relief valves; 5 is a high-pressure energy accumulator, 6 and 7 are sensors; 8, 9, 10, 11, 12 and 13 are electro-hydraulic proportional valves; 14 is an intermediate-pressure energy accumulator; 15 and 15' are single-rod elevation hydraulic cylinders; 16 is a main hydraulic cylinder; 17 is a forging hammer; 18 is a movable beam; 19 is a programmable logic controller (PLC); and 20 is a remote console.

DETAILED DESCRIPTION OF THE PREFERRED EMBODIMENTS

The detailed description of the present disclosure is presented largely in terms of procedures, steps, logic blocks, processing, or other symbolic representations that directly or indirectly resemble the operations of devices or systems contemplated in the present disclosure. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be comprised in at least one embodiment of the present disclosure. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the present disclosure do not inherently indicate any particular order nor imply any limitations in the present disclosure.

A high-speed hydraulic forging press according to the present disclosure is further explained and described below with reference to the accompany drawings.

As shown in FIG. 1, a high-speed hydraulic forging press 100 may include a forging hammer 17, a movable beam 18, a main hydraulic cylinder 16, single-rod elevation hydraulic cylinders 15 and 15', a plurality of main hydraulic pumps 1, 1' and 1", a high-pressure energy accumulator 5, an intermediate-pressure energy accumulator 14, a first sensor 6, a second sensor 7, a PLC 19, a plurality of electromagnetic reversing valves 2, 2' and 2", a plurality of electro-hydraulic proportional valves 8, 9, 10, 11, 12 and 13, and a piping system comprising a plurality of pipes. The electro-hydraulic proportional valves 8, 9, 10 and 11 may be referred as a first electro-hydraulic proportional valve, a second electro-hydraulic proportional valve, a third electro-hydraulic proportional valve, and a fourth electro-hydraulic proportional valve, respectively, and the electro-hydraulic proportional valves 12 and 13 may be referred as fifth electro-hydraulic proportional valves.

As shown in FIG. 1, main hydraulic cylinder 16 may be a plunger-type hydraulic cylinder. Forging hammer 17 of the high-speed hydraulic forging press may be connected to a plunger 16*a* of main hydraulic cylinder 16 via movable beam 18. When the space of main hydraulic cylinder 16 close to one end of the plunger 16*a* is filled with hydraulic oil, forging hammer 17 may drop in an idle stroke. Each of single-rod elevation hydraulic cylinders 15 and 15' may be disposed on each of two sides of main hydraulic cylinder 16, respectively. A single rod (i.e., rod 15*a* or 15'*a*) in each of single-rod elevation hydraulic cylinders 15 and 15' may be linked to, and thus able to move integrally with, forging hammer 17 via movable beam 18. When rod cavities of single-rod elevation hydraulic cylinders 15 and 15' are filled with hydraulic oil, forging hammer 17 may rise for a backhaul.

When forging hammer 17 is dropping in the idle stroke, a hydraulic connection may be established between an oil tank 99 and the rod cavities of single-rod hydraulic cylinders 15 and 15'. Electro-hydraulic proportional valve 11 may be disposed on a pipe connecting the oil tank 99 and the rod cavities of single-rod hydraulic cylinders 15 and 15'. Specifically, electro-hydraulic proportional valve 11 may be used to establish or disable a hydraulic connection of the pipe. In the embodiment shown in FIG. 1, three main hydraulic pumps, namely, 1, 1' and 1", are provided. In other embodiments, two, four, or five main hydraulic pumps may be provided instead, as needed. Intermediate-pressure energy accumulator 14 may have an energy accumulation pressure rating of 0.3 Mpa to 3 Mpa. When forging hammer 17 rises during the backhaul, hydraulic oil in the rod cavities of single-rod elevation hydraulic cylinders 15 and 15' may be supplied by each of main hydraulic pumps 1, 1' and 1", and hydraulic oil in main hydraulic cylinder 16 may be discharged into intermediate-pressure energy accumulator 14. When forging hammer 17 drops fast in an idle stroke, hydraulic oil in main hydraulic cylinder 16 may be solely supplied by intermediate-pressure energy accumulator 14. Meanwhile, hydraulic oil in the rod cavities of single-rod elevation hydraulic cylinders 15 and 15' may be discharged into the oil tank 99. Concurrently, main hydraulic pumps 1, 1' and 1" may supply hydraulic oil to high-pressure energy accumulator 5 to accumulate energy therein. During rolling of forging hammer 17, hydraulic oil in main hydraulic cylinder 16 may be supplied by main hydraulic pumps 1, 1' and 1" as well as high-pressure energy accumulator 5 at the same time. When the rolling resistance applied to forging hammer 17 by a workpiece increases to cause pressure in main hydraulic cylinder 16 to reach a first predetermined value, high-pressure energy accumulator 5 may stop supplying hydraulic oil to main hydraulic cylinder 16, and the hydraulic oil in main hydraulic cylinder 16 may be supplied by main hydraulic pumps 1, 1' and 1". When the rolling resistance applied to forging hammer 17 further increases to cause the pressure in main hydraulic cylinder 16 to further reach a second predetermined value that is greater than the first predetermined value, one or more of main hydraulic pumps 1, 1' and 1" may be switched to supplying hydraulic oil to high-pressure energy accumulator 5 to accumulate energy therein, and the hydraulic oil in main hydraulic cylinder 16 may be supplied by one or more remaining main hydraulic pumps that are not switched.

As shown in FIG. 1, electromagnetic reversing valves 2, 2' and 2" may respectively be disposed on pipes via which main hydraulic pumps 1, 1' and 1" may output hydraulic oil. Specifically, electromagnetic reversing valves 2, 2' and 2" may be used to switch between (a) supplying hydraulic oil from main hydraulic pumps 1, 1' and 1" to main hydraulic cylinder 16 and single-rod elevation hydraulic cylinders 15 and 15' and (b) supplying hydraulic oil from main hydraulic pumps 1, 1' and 1" to high-pressure energy accumulator 5. Electro-hydraulic proportional valve 10 may be disposed on a pipe via which main hydraulic pumps 1, 1' and 1" may supply hydraulic oil to the rod cavities of single-rod elevation hydraulic cylinders 15 and 15'. Specifically, electro-hydraulic proportional valve 10 may be used to establish or disable a hydraulic connection of the pipe. Electro-hydraulic proportional valves 12 and 13 may be disposed on a pipe connecting intermediate-pressure energy accumulator 14 and main hydraulic cylinder 16. Specifically, electro-hydraulic proportional valves 12 and 13 may be used to establish or disable a hydraulic connection of the pipe. Electro-hydraulic proportional valve 9 may be disposed on a pipe via which main hydraulic pumps 1, 1' and 1" may supply hydraulic oil to main hydraulic cylinder 16. Specifically, electro-hydraulic proportional valve 9 may be used to establish or disable a hydraulic connection of the pipe. Electro-hydraulic proportional valve 8 may be disposed on a pipe via which high-pressure energy accumulator 5 may supply hydraulic oil to main hydraulic cylinder 16. Specifically, electro-hydraulic proportional valve 8 may be used to establish or disable a hydraulic connection of the pipe. Sensor 6 may be disposed on a pipe via which high-pressure energy accumulator 5 may output hydraulic oil, whereas sensor 7 may be disposed on a pipe hydraulically connected to main hydraulic cylinder 16. Based on sensing signals generated by first sensor 6 and second sensor 7 as well as an input signal received via remote console 20, PLC 19 may control electromagnetic reversing valves (i.e., electromagnetic reversing valves 2, 2' and 2") and electro-hydraulic proportional valves (i.e., electro-hydraulic proportional valves 8, 9, 10, 11, 12 and 13) by sending open and/or close commands to them (i.e., electromagnetic reversing valves 2, 2' and 2" and/or electro-hydraulic proportional valves 8, 9, 10, 11, 12 and 13) respectively.

With the disclosure above applied, an operation process of an improved 16 MN high-speed forging press may have the following phases:

1. Start:

PLC 19 may send commands to the three main hydraulic pumps 1, 1' and 1", and the three main hydraulic pumps 1, 1' and 1" may start without loads.

2. Backhaul:

PCL 19 may send commands to control electro-hydraulic proportional valves 10, 12 and 13 to open, to control left channels (labeled "L" in FIG. 1) of electromagnetic reversing valves 2, 2' and 2" to open, and to control electro-hydraulic proportional valves 8, 9 and 11 to close. The three main hydraulic pumps 1, 1' and 1" may supply hydraulic oil to the rod cavities of single-rod elevation hydraulic cylinders 15 and 15' via the left channels of the electromagnetic reversing valves 2, 2' and 2" and electro-hydraulic proportional valve 10. Forging hammer 17 may thus rise. Hydraulic oil in main hydraulic cylinder 16 may be discharged into intermediate-pressure energy accumulator 14 via electro-hydraulic proportional valves 12 and 13.

3. Fast Drop of Forging Hammer in an Idle Stroke:

PLC 19 may send commands to control electro-hydraulic proportional valves 11, 12 and 13 to open, to control right channels of electromagnetic reversing valves 2, 2' and 2" to open, and to control electro-hydraulic proportional valves 8, 9 and 10 to close. Intermediate-pressure energy accumulator 14 may supply hydraulic oil to main hydraulic cylinder 16 via electro-hydraulic proportional valves 12 and 13. Forging hammer 17 may drop fast in an idle stroke and touch a workpiece quickly. Hydraulic oil in the rod cavities of single-rod elevation hydraulic cylinders 15 and 15' may be discharged into the oil tank 99 via electro-hydraulic proportional valve 11. The three main hydraulic pumps 1, 1' and 1" may supply, via the right channels (labeled "R" in FIG. 1) of electromagnetic reversing valves 2, 2' and 2", hydraulic oil to high-pressure energy accumulator 5 to accumulate energy therein. When sensor 6 detects that pressure in high-pressure energy accumulator 5 has reached a fourth predetermined value, PLC 19 may send commands to control the right channels of electromagnetic reversing valves 2, 2', and 2" to close. The three main hydraulic pumps 1, 1', and 1" may thus run without loads.

4. Rolling:

PLC 19 may send commands to control electro-hydraulic proportional valves 10, 12 and 13 to close, to control electro-hydraulic proportional valves 8 and 9 to open, and to control the left channels of electromagnetic reversing valves 2, 2' and 2" to open. The three main hydraulic pumps 1, 1' and 1" may supply hydraulic oil to main hydraulic cylinder 16 via electro-hydraulic proportional valve 9. Meanwhile, high-pressure energy accumulator 5 may also supply hydraulic oil to main hydraulic cylinder 16 via electro-hydraulic proportional valve 8. As resistance of the workpiece continuously increases, pressure in main hydraulic pumps 1, 1' and 1" may also increase accordingly. When sensor 7 detects that pressure in the main hydraulic cylinder 16 has reached the first predetermined value, PLC 19 may send a command to control electro-hydraulic proportional valve 8 to close. At this time, electro-hydraulic proportional valve 9 may remain open, electro-hydraulic proportional valves 10, 12 and 13 may remain closed, and the left channels of electromagnetic reversing valves 2, 2' and 2" may be open, causing high-pressure energy accumulator 5 to stop supplying hydraulic oil to main hydraulic cylinder 16, and main hydraulic pumps 1, 1' and 1" may supply hydraulic oil to main hydraulic cylinder 16 via electro-hydraulic proportional valve 9. When sensor 7 detects that the pressure in main hydraulic cylinder 16 has reached the second predetermined value, PLC 19 may send commands to control the right channels of electromagnetic reversing valves 2' and 2" to open, whereas states of other electro-hydraulic proportional valves and electromagnetic reversing valve 2 may stay unchanged. That is, main hydraulic pumps 1' and 1" are switched to supplying hydraulic oil to high-pressure energy accumulator 5 to accumulate energy therein, and only main hydraulic pump 1 may supply hydraulic oil to main hydraulic cylinder 16 to sustain the rolling of the workpiece. When a size of the workpiece has met a requirement and the rolling ends, or when sensor 7 detects that the pressure in the main hydraulic cylinder 16 has reached a third predetermined value due to an increase in the rolling resistance, PLC 19 may send commands to control the left channel of main hydraulic pump 1 to close and the right channel of the main hydraulic pump 1 to open. The three main hydraulic pumps 1, 1' and 1" may all be switched to supplying hydraulic oil to high-pressure energy accumulator 5 to accumulate energy therein. The first predetermined value is smaller than the second predetermined value, the second predetermined value is smaller than the third predetermined value, and the fourth predetermined value is greater than the first predetermined value.

It should be noted that any modification made by a person skilled in the art to the embodiments disclosed in the present disclosure would still be considered within the scope of the claims of the present application. Accordingly, the scope of the claims of the present application is not limited to the foregoing embodiments.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A high-speed hydraulic forging press, comprising:

a forging hammer;

a movable beam;

a main hydraulic cylinder;

a single-rod elevation hydraulic cylinder;

a plurality of main hydraulic pumps;

a high-pressure energy accumulator;

an intermediate-pressure energy accumulator;

an oil tank;

a programmable logic controller;

a piping system comprising a plurality of pipes and capable of transmitting hydraulic oil; and a valve-regulation system disposed on the piping system, wherein:

the piping system is connected with the main hydraulic cylinder, the single-rod elevation hydraulic cylinder, the plurality of main hydraulic pumps, the high-pressure energy accumulator, the intermediate-pressure energy accumulator and the oil tank, the main hydraulic cylinder is a plunger-type hydraulic cylinder, one end of a single rod of the single-rod elevation hydraulic cylinder, one end of a plunger of the main hydraulic cylinder and the forging hammer are fixedly connected to the movable beam, when the forging hammer rises, the programmable logic controller controls the valve-regulation system so that the hydraulic oil in a rod cavity of the single-rod elevation hydraulic cylinder is supplied by the plurality of main hydraulic pumps pumping the hydraulic oil from the oil tank, and that the hydraulic oil in the main hydraulic cylinder is discharged into the intermediate-pressure energy accumulator, when the forging hammer drops, the programmable logic controller controls the valve-regulation system so that the hydraulic oil in the main hydraulic cylinder is solely supplied by the intermediate-pressure energy accumulator, that the hydraulic oil in the rod cavity of the single-rod elevation hydraulic cylinder is discharged into the oil tank, and that the main hydraulic cylinder supplies the hydraulic oil to the high-pressure energy accumulator to accumulate energy therein, when the forging hammer touches a workpiece, the programmable logic controller controls the valve-regulation system so that the hydraulic oil in the main hydraulic cylinder is supplied by the main hydraulic pumps and the high-pressure energy accumulator, and when a resistance applied to the forging hammer by the workpiece increases causing pressure in the main hydraulic cylinder to reach a first predetermined value, the programmable logic controller controls the valve-regulation system so that the high-pressure energy accumulator stops supplying the hydraulic oil to the main hydraulic cylinder, and that the hydraulic oil in the main hydraulic cylinder is supplied by at least one of the plurality of main hydraulic pumps.

2. The high-speed hydraulic forging press according to claim 1, wherein:

when the resistance increases causing the pressure in the main hydraulic cylinder to reach the first predetermined value but not a second predetermined value greater than the first predetermined value, the programmable logic controller controls the valve-regulation system so that the high-pressure energy accumulator stops supplying the hydraulic oil to the main hydraulic cylinder, and that the hydraulic oil in the main hydraulic cylinder is supplied by each of the plurality of main hydraulic pumps pumping the hydraulic oil from the oil tank, and when the resistance increases causing the pressure in the main hydraulic cylinder to further reach the second predetermined value, the programmable logic controller controls the valve-regulation system so that one or more of the plurality of main hydraulic pumps are switched to supplying the hydraulic oil to the high-pressure energy accumulator to accumulate energy therein, and that the hydraulic oil in the main hydraulic cylinder is supplied by remaining of the plurality of main hydraulic pumps that are not switched.

3. The high-speed hydraulic forging press according to claim 2, wherein:

when the resistance increases causing the pressure in the main hydraulic cylinder to further reach a third predetermined value greater than the second predetermined value, the programmable logic controller controls the valve-regulation system so that all of the plurality of main hydraulic pumps are switched to supplying hydraulic oil to the high-pressure energy accumulator to accumulate energy therein.

4. The high-speed hydraulic forging press according to claim 1, wherein the valve-regulation system comprises:

one or more electromagnetic reversing valves respectively disposed on one or more of the plurality of pipes via which the plurality of main hydraulic pumps output the hydraulic oil, the one or more electromagnetic reversing valves controlled by the programmable logic controller such that each of the plurality of main hydraulic pumps supplies the hydraulic oil to the main hydraulic cylinder, the single-rod elevation hydraulic cylinder or the high-pressure energy accumulator;

a first electro-hydraulic proportional valve disposed on a first pipe of the plurality of pipes via which the high-pressure energy accumulator supplies the hydraulic oil to the main hydraulic cylinder, the first electro-hydraulic proportional valve controlled by the programmable logic controller and thus capable of establishing or disabling a hydraulic connection of the first pipe;

a second electro-hydraulic proportional valve disposed on a second pipe of the plurality of pipes via which the plurality of main hydraulic pumps supply the hydraulic oil to the main hydraulic cylinder, the second electro-hydraulic proportional valve controlled by the programmable logic controller and thus capable of establishing or disabling a hydraulic connection of the second pipe;

a third electro-hydraulic proportional valve disposed on a third pipe of the plurality of pipes via which the plurality of main hydraulic pumps supply the hydraulic oil to the rod cavity of the single-rod elevation hydraulic cylinder, the third electro-hydraulic proportional valve controlled by the programmable logic controller and thus capable of establishing or disabling a hydraulic connection of the third pipe;

a fourth electro-hydraulic proportional valve disposed on a fourth pipe of the plurality of pipes, the fourth pipe disposed between the oil tank and the rod cavity of the single-rod hydraulic cylinder, the fourth electro-hydraulic proportional valve controlled by the programmable logic controller and thus capable of establishing or disabling a hydraulic connection of the fourth pipe; and a fifth electro-hydraulic proportional valve disposed on a fifth pipe of the plurality of pipes, the fifth pipe connecting the intermediate-pressure energy accumulator and the main hydraulic cylinder, the fifth electro-hydraulic proportional valve controlled by the programmable logic controller and thus capable of establishing or disabling a hydraulic connection of the fifth pipe, and wherein the high-speed hydraulic forging press further comprises:

a first sensor disposed on a sixth pipe of the plurality of pipes via which the high-pressure energy accumulator outputs the hydraulic oil; and a second sensor disposed on a seventh pipe of the plurality of pipes hydraulically connected to the main hydraulic cylinder.

5. The high-speed hydraulic forging press according to claim 4, further comprising:

a remote console, wherein the programmable logic controller controls the one or more electromagnetic reversing valves and the first, second, third, fourth and fifth electro-hydraulic proportional valves based on sensing signals generated by the first and second sensors and an input signal received via the remote console.

6. The high-speed hydraulic forging press according to claim 4, wherein:

during a start operation phase, the programmable logic controller sends a first command to control each of the plurality of the main hydraulic pumps to start without loads, during a backhaul operation phase, the programmable logic controller sends a second command to control the third electro-hydraulic proportional valve and the fifth electro-hydraulic proportional valve to open, to control a left channel of each of the one or more electromagnetic reversing valves to open, and to control the first electro-hydraulic proportional valve, the second electro-hydraulic proportional valve and the fourth electro-hydraulic proportional valve to close, wherein each of the plurality of main hydraulic pumps supply the hydraulic oil to the rod cavity of the single-rod elevation hydraulic cylinder via the left channel of each of the one or more electromagnetic reversing valves and the third electro-hydraulic proportional valve, wherein the forging hammer rises, and wherein the hydraulic oil in the main hydraulic cylinder is discharged into the intermediate-pressure energy accumulator via the fifth electro-hydraulic proportional valve, during a fast drop operation phase, the programmable logic controller sends a third command to control the fourth electro-hydraulic proportional valve and the fifth electro-hydraulic proportional valve to open, to control a right channel of each of the one or more electromagnetic reversing valves to open, and to control the first electro-hydraulic proportional valve, the second electro-hydraulic proportional valve and the third electro-hydraulic proportional valve to close, wherein the intermediate-pressure energy accumulator supplies the hydraulic oil to the main hydraulic cylinder via the fifth electro-hydraulic proportional valve, wherein the forging hammer drops and touches the workpiece, wherein the hydraulic oil in the rod cavity of the single-rod elevation hydraulic cylinder is discharged into the oil tank via the fourth electro-hydraulic proportional valve, wherein each of the plurality of main hydraulic pumps supplies, via the right channel of each of the one or more electromagnetic reversing valves, the hydraulic oil to the high-pressure energy accumulator to accumulate energy therein, wherein, when the first sensor detects that the pressure in the high-pressure energy accumulator reaches a fourth predetermined value, the programmable logic controller sends a fourth command to control the right channel of each of the one or more electromagnetic reversing valves to close, and wherein each of the plurality of main hydraulic pumps runs without loads, and during a rolling operation phase, the programmable logic controller sends a fifth command to control the third electro-hydraulic proportional valve and the fifth electro-hydraulic proportional valve to close, to control the first electro-hydraulic proportional valve and the second electro-hydraulic proportional valve to open, and to control the left channel of each of the one or more electromagnetic reversing valves to open, wherein each of the plurality of main hydraulic pumps supply the hydraulic oil to the main hydraulic cylinder via the second electro-hydraulic proportional valve, wherein the high-pressure energy accumulator supplies the hydraulic oil to the main hydraulic cylinder via the first electro-hydraulic proportional valve, wherein, when the second sensor detects that the pressure in the main hydraulic cylinder reaches the first predetermined value, the programmable logic controller sends a sixth command to control the first electro-hydraulic proportional valve to close and to keep the left channel of each of the one or more electromagnetic reversing valves to remain open so that the high-pressure energy accumulator stops supplying the hydraulic oil to the main hydraulic cylinder and that the hydraulic oil in the main hydraulic cylinder is supplied by each of the plurality of main hydraulic pumps, wherein, when the second sensor detects that the pressure in the main hydraulic cylinder reaches a second predetermined value, the programmable logic controller sends a seventh command to control the right channel of at least one of the one or more electromagnetic reversing valves to open so that at least one of the plurality of main hydraulic pumps is switched to supplying the hydraulic oil to the high-pressure energy accumulator to accumulate energy therein.

7. The high-speed hydraulic forging press according to claim 6, wherein:

when the second sensor detects that the pressure in the main hydraulic cylinder reaches a third predetermined value, the programmable logic controller sends an eighth command to control the right channel of each of the one or more electromagnetic reversing valves to open so that each of the plurality of main hydraulic pumps is switched to supplying the hydraulic oil to the high-pressure energy accumulator to accumulate energy therein.

8. The high-speed hydraulic forging press according to claim 1, wherein the intermediate-pressure energy accumulator has an energy accumulation pressure rating of 0.3 megapascal (Mpa) to 3 Mpa.

9. The high-speed hydraulic forging press according to claim 1, wherein the high-pressure energy accumulator has an energy accumulation pressure rating of 3 megapascal (Mpa) to 35 Mpa.

* * * * *